US006666795B2

(12) United States Patent
Mah

(10) Patent No.: US 6,666,795 B2
(45) Date of Patent: Dec. 23, 2003

(54) GYMNASTICS GRIP AND PROCESS FOR MAKING SAME

(75) Inventor: Jung Y. Mah, Hamilton (CA)

(73) Assignee: Bakado Enterprises Inc., Toronto (CA)

( * ) Notice: Subject to any disclaimer, the term of this patent is extended or adjusted under 35 U.S.C. 154(b) by 0 days.

(21) Appl. No.: 10/123,307

(22) Filed: Apr. 17, 2002

(65) Prior Publication Data

US 2003/0199364 A1 Oct. 23, 2003

(51) Int. Cl.[7] ..... A63B 26/00; A41D 19/00
(52) U.S. Cl. ..... 482/23; 2/161.1; 2/161.4
(58) Field of Search ..... 482/23, 49; 2/160, 2/161.1, 161.4, 16, 20

(56) References Cited

U.S. PATENT DOCUMENTS

| | | | | |
|---|---|---|---|---|
| 4,000,903 A | | 1/1977 | Swanson | |
| 4,400,831 A | | 8/1983 | Rietz | |
| 4,720,279 A | | 1/1988 | Fritschen et al. | |
| 5,298,001 A | | 3/1994 | Goodson | |
| 5,353,440 A | | 10/1994 | Meldeau | |
| 5,809,570 A | | 9/1998 | Grover | |
| 5,888,180 A | * | 3/1999 | Dewberry | 482/139 |
| 5,898,944 A | * | 5/1999 | Vrany | 2/161.4 |

* cited by examiner

*Primary Examiner*—Jerome W. Donnelly
*Assistant Examiner*—Fenn C Mathew
(74) *Attorney, Agent, or Firm*—Patrick J. Hofbauer

(57) ABSTRACT

A gymnastics grip, and a process for making same, wherein the grip is for attachment to the wrist and fingers of a gymnast and has a palm portion defining a longitudinal axis, a palm face, and a finger end, and a dowel defining a dowel axis. The dowel is attached to the palm face adjacent the finger end, with the dowel axis transverse to the longitudinal axis, by a flap secured to the palm face by a first stitching passing through the flap and the palm face parallel to the dowel axis. A first portion of the flap extends from the first stitching to substantially surround the dowel, without intervening between the dowel and the first stitching, and is secured adjacent a free end thereof to the palm face by a second stitching passing through the free end and the palm face parallel to the first stitching.

16 Claims, 3 Drawing Sheets

GYMNASTICS GRIP AND PROCESS FOR MAKING SAME

FIELD OF THE INVENTION

The present invention relates generally to apparatus for use in performing gymnastics routines, and more particularly to a gymnastics grip suitable for use on, for example, the uneven bars, the high bar, or the rings.

BACKGROUND OF THE INVENTION

Gymnastics is an increasingly popular and highly competitive sport that is actually the aggregation of a number of different exercises and gymnastic routines performed on a variety of apparatus. Some of the most challenging gymnastic routines are performed on the uneven bars, the high bar, and the rings. While performing these different routines, a gymnast holds onto one or more bars or rings, as appropriate, while swinging his or her arms and body about same or in relation thereto. The gymnast typically applies a slipping agent, such as a chalk dust, a powder, or the like, to his or her hands to allow for their easy sliding in relation to the bar(s) or rings in question, and to reduce the potential friction therebetween. As such, the high degree of strain that would ordinarily be imposed upon the gymnast's forearms, wrists, hands, and fingers in performing such a routine is, in fact, further exacerbated by the increased pressure that must, at times, be utilized by a gymnast in order counter the slipping agent applied to the gymnast's hands, so as to maintain a firm grip upon the apparatus when desired. Common problems experienced by gymnasts in practising for and performing uneven bar, high bar, or ring routines can include any or all of the following: loss of grip on the apparatus; muscle fatigue in the forearms, wrists, hands or fingers; the development of callouses on the fingers or hands; and improper technique or improper grip on the apparatus.

Only in recent times have gymnastics grips been developed with the aim of overcoming one or more of these problems. A conventional gymnastics grip for use on the uneven bars, the high bar, or the rings typically includes a leather palm portion that, when worn, extends from the wrist to the fingertips of the gymnast, a strap attached to a wrist end of the palm portion for securing same to the gymnast's wrist, two or three holes at a finger end of the palm portion for insertion of fingers therethrough, and a transverse dowel, rib, or rod member fixedly attached to a palm face of the palm portion, near its finger end, by glue, a stitched sleeve, or some combination thereof. An example of such a gymnastics grip can be seen in U.S. Pat. No. 5,298,001 (Goodson) for a Gymnastics Safety Grip Apparatus. It should be noted that the Goodson patent also discloses an additional feature which is not relevant to the present invention, namely, an elastic strap attached near the finger end of the palm portion, directed to preventing the grip's release from the gymnast's fingers during use. Notwithstanding this feature, gymnastics grips of this general type are well-known in the art to slow the formation of callouses, to encourage proper technique, to improve a gymnast's hold on the apparatus, and to reduce muscle fatigue and the strain imposed upon the gymnast's forearms, wrists, hands, and fingers.

In fact, dowels, ribs, and rod members are used in sports grips for other uses. For example, U.S. Pat. No. 4,720,279 (Fritschen et al.) suggests a grip, for use in the sport of water skiing, having a palm portion and a terminal finger end thereof which is folded over a transverse rib and stitched to itself to secure the rib in place. U.S. Pat. No. 4,400,831 (Rietz) is also for use in water sports and specifically contemplates a transverse rib or dowel that is tightly secured, by stitching and adhesive, inside a pocket formed by a tuck or fold in a palm portion of a glove. U.S. Pat. No. 4,000,903 (Swanson) illustrates a similar design for a golf glove, having a cord or rod member positioned on the palm portion of the glove, which rod member is secured in place, either by a tuck in the palm of the glove material which is wrapped around the cord and closed by stitching, or by covering the cord with a strip or sleeve of similar material, which material is then joined to the palm of the glove by a row of stitching running around the perimeter of the cord. The Swanson patent contemplates that an adhesive might also be used in place of the stitching.

A problem common to all of the prior art, including each of the above listed references, which problem is particularly acute in respect of gymnastics grips, is that of inadequate securement of the dowel to the palm portion of the grip. Specifically, in the gymnastics context, dowels secured inside pockets formed in the material of the grip, whether by stitching, adhesive or a combination of both, are known to frequently become detached from the grip. Likewise, dowels secured within a sleeve or flap attached to the grip by adhesive are known to be subject to unravelling. As well, because of the magnitude and direction of the forces applied by a gymnast performing on the uneven bars, the high bar, or the rings, stitching that is exposed wristward of a dowel secured thereby is prone to excessive strain that is commonly known to rend and unravel an otherwise enduring seam. All of these deficiencies in the prior art have the effect of lessening the useful lifetime and reliability of a grip. Moreover, should a gymnastics grip actually fail while in use by a gymnast, serious injury and/or embarrassment to the wearer may occur.

The primary object of the invention is to provide a gymnastics grip, and a process for making same, which gymnastics grip is for use by a gymnast on the uneven bars, the high bar, or the rings, and has a dowel member that is not prone to unravelling or detachment.

Another object of one aspect of the invention is to provide a gymnastics grip, and a process for making same, which gymnastics grip eliminates any stitching exposed wristward of the dowel member, so as to decrease the forces directly at work upon the stitching.

Another object of the invention is to provide a gymnastics grip, and a process for making same, which gymnastics grip has an increased durability, strength and useful lifetime.

Yet another object of the invention is to provide a gymnastics grip, and a process for making same, which gymnastics grip aids the gymnast in maintaining his or her hold on the apparatus.

Still yet another object of the invention is to provide a gymnastics grip, and a process for making same, which gymnastics grip provides the gymnast with a more comfortable grip upon the uneven bars, the high bar, or the rings.

A further object of the invention is to provide a gymnastics grip, and a process for making same, which gymnastics grip reduces the predisposition for callous formation on the fingers and hands of the gymnast.

A further object of the invention is to provide a gymnastics grip, and a process for making same, which gymnastics grip encourages the gymnast's use of proper technique and proper grip on the apparatus.

Yet a further object of the invention is to provide a gymnastics grip, and a process for making same, which gymnastics grip reduces muscle fatigue in the forearms, wrists, hands and fingers of a gymnast.

Yet a further object of the invention is to provide a gymnastics grip, and a process for making same, which gymnastics grip reduces the risk of serious injury to the gymnast.

Still yet a further object of the invention is to provide a gymnastics grip, and a process for making same, which gymnastics grip is relatively easy and inexpensive to manufacture.

SUMMARY OF THE INVENTION

In accordance with the present invention there is disclosed a gymnastics grip and a process for making same, in which the gymnastics grip has a palm portion, defining a longitudinal axis, and a substantially cylindrical dowel member, defining a dowel axis. The palm portion of the grip has a palm face, a wrist end portion, means for securing the wrist end portion to a wrist of a gymnast, a finger end portion, and means for securing the finger end portion to at least one finger of the gymnast. The dowel member is attached to the palm face adjacent the finger end portion, with the dowel axis in substantially transverse relation to the longitudinal axis of the palm portion. In order to so attach the dowel member, a flap member is secured adjacent to the palm face by one or more first rows of stitching passing through the flap member and the palm face in substantially parallel relation to the dowel axis. The dowel member is positioned adjacent to the one or more first rows of stitching with the dowel axis in substantially transverse relation to the longitudinal axis, as aforesaid. A first flap portion of the flap member extends in a first direction from the one or more first rows of stitching to substantially surround the dowel member in first encircling relation, without intervening between the one or more first rows of stitching and the dowel member. The first flap portion is secured adjacent a free end thereof to the palm face by one or more second rows of stitching passing through the free end and the palm face in substantially parallel relation to the first row of stitching.

According to another aspect of the present invention, the flap member may also have a second flap portion which extends in a second direction opposed to said first direction from the one or more first rows of stitching to substantially surround the dowel member in second encircling relation, such that the first flap portion substantially surrounds both the dowel member and the second flap portion in first encircling relation.

According to a further aspect of the present invention, the one or more second rows of stitching pass through the palm face at a position located between the finger end portion and the one or more first rows of stitching.

According to a still further aspect of the present invention, an adhesive may be used on an inner face of the flap member.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which are briefly described hereinbelow.

DETAILED DESCRIPTION OF A PREFERRED EMBODIMENT

Figure 1:
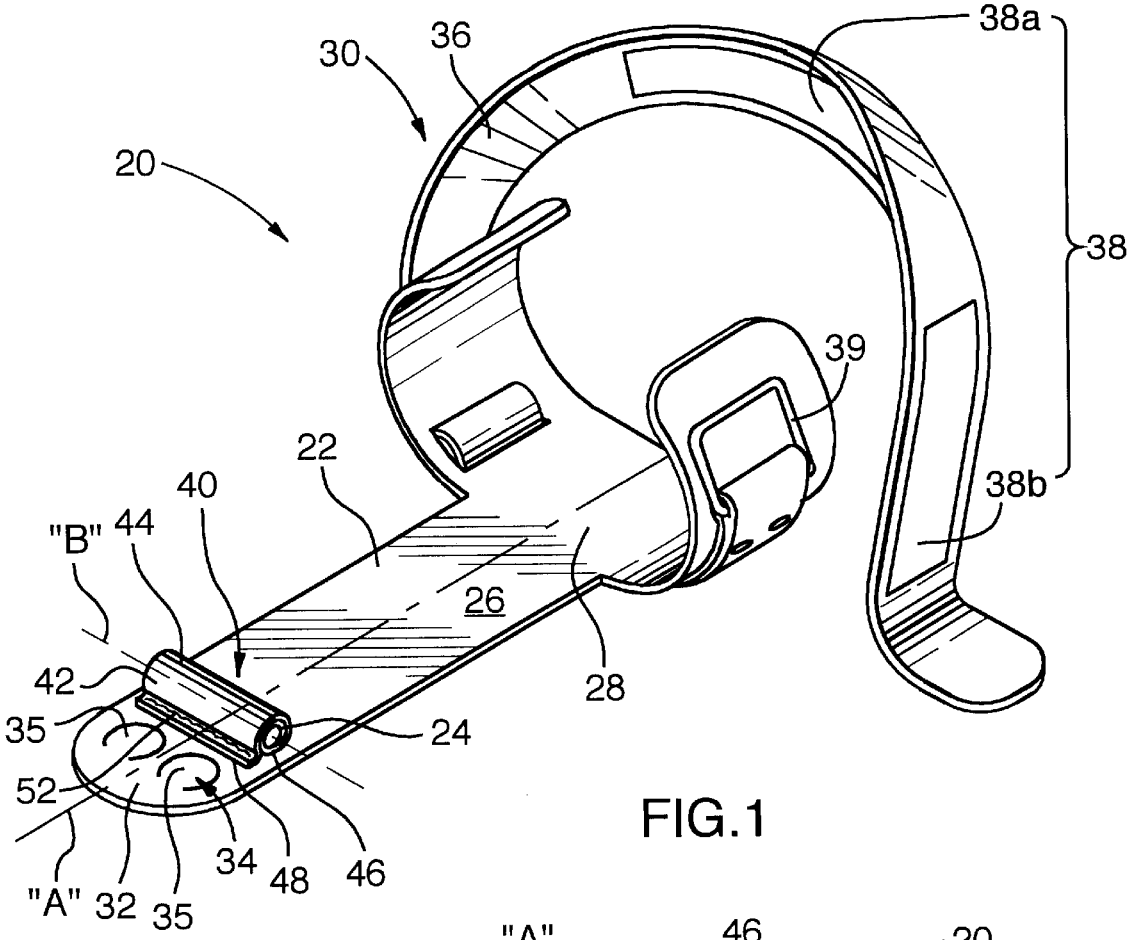
FIG. 1 is a perspective view of a preferred embodiment of a gymnastics grip according to the invention.

FIG. 1 shows a preferred embodiment of a gymnastics grip 20 comprising a palm portion 22 and a dowel member 24. The palm portion 22 is of the conventional type for use by a gymnast on the uneven bars or the rings, being constructed from leather, defining a longitudinal axis "A", and comprising a palm face 26, a wrist end portion 28, means 30 for securing the wrist end portion 28 to a wrist of the gymnast, a finger end portion 32, and means 34 for securing the finger end portion 32 to two fingers of the gymnast. The finger end securing means 34 comprises the shaping of the finger end portion 32 so as to define two finger holes 35. The wrist end securing means 30 comprises a strap 36 attached to the wrist end portion 28. The strap 36 is provided with means for self closure, preferably comprising a buckle frame 39 and a Velcro™ hook 38*a* and loop 38*b* closure system 38.

The dowel member 24 is also of the conventional type, being substantially cylindrical and defining a dowel axis "B". The dowel member 24 is preferably constructed from a semi-rigid plastics material selected from the group consisting of ethylene vinyl acetate, nylon, polyester, polyethylene, polypropylene, polyurethane, polyvinyl chloride, silicone, natural rubber, synthetic rubber, and neoprene.

Figure 6:
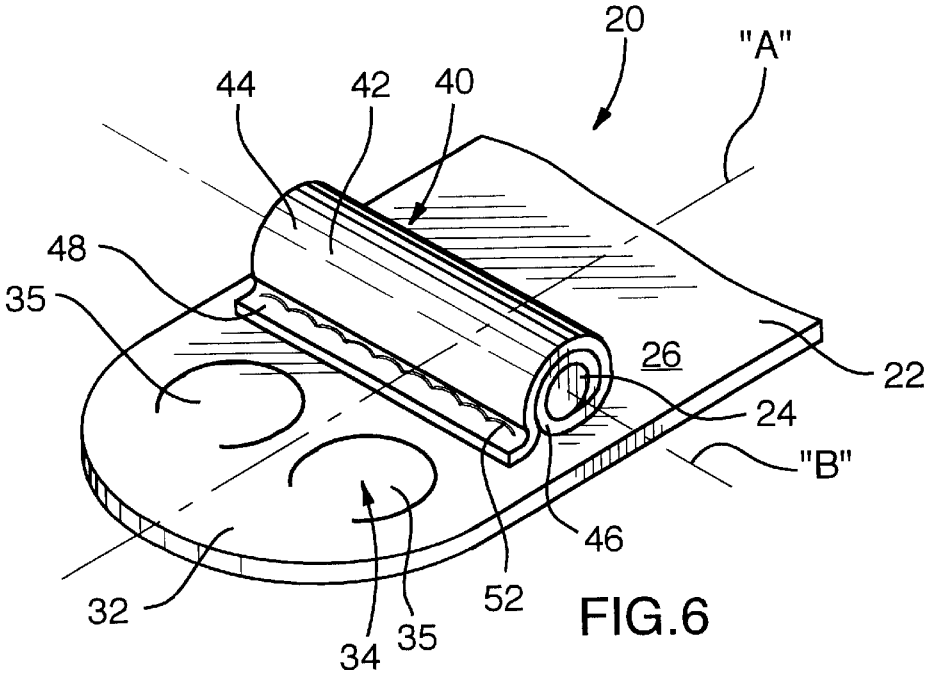
FIG. 6 is a perspective view of the finger end portion of the improved gymnastics grip of FIG. 1.

According to the invention, and with specific reference to FIGS. 1, 2, 3 and 6, the gymnastics grip 20 is provided with means 40 for attaching the dowel member 24 to the palm face 26, adjacent the finger end portion 32, with the dowel axis "B" in substantially transverse relation to the longitudinal axis "A". The dowel attaching means 40 comprises a flap member 42 secured adjacent to the palm face 26 by two first rows of stitching 50, 50, which two first rows of stitching 50, 50, while not being directly visible in either of FIGS. 1 or 6, are clearly discernable in both FIGS. 2 and 3, the latter figures showing the dowel attaching means 40 respectively in a first and a second assembly configuration.

The two first rows of stitching 50, 50 pass through the flap member 42 and the palm face 26 in substantially transverse relation to the longitudinal axis "A" and in substantially parallel relation to the dowel axis "B". The flap member 42 may optionally have an adhesive applied to an inner face 54 thereof.

A first flap portion 44 of the flap member 42 extends in a first direction (as indicated by arrow "C" in FIG. 2) from the two first rows of stitching 50, 50 to substantially surround, in first encircling relation, both the dowel member 24 and a second flap portion 46 of the flap member 42. The second flap portion 46 extends in a second direction (as indicated by arrow "D" in FIG. 2), opposed to the first direction "C", from the two first rows of stitching 50, 50 to substantially surround the dowel member 24 in second encircling relation. It is essential that the first flap portion 44 must not intervene between the two first rows of stitching 50, 50 and the dowel member 24, but the second flap portion 46 may or may not do so, depending on the precise positioning of the dowel member 24 relative to the flap member 42.

As seen most clearly in FIG. 6, the first flap portion 44 is secured adjacent a free end 48 thereof to the palm face 26 by a second row of stitching 52 passing through the free end 48 and the palm face 26 in substantially parallel relation to the dowel axis "B" (and the two first rows of stitching 50, 50). In the preferred embodiment shown, the dowel attaching means 40 is oriented such that the second row of stitching 52 is positioned between the finger end portion 32 and the two first rows of stitching 50, 50.

In use, the gymnast places the palm face 26 of the gymnastics grip 20 adjacent a palm of his or her hand and inserts a middle and a ring finger of that hand into the two finger holes 35, to snugly fit their tips therein. The gymnast then secures the gymnastics grip 20 to his or her corresponding wrist by wrapping the wrist end portion 28 thereabout, folding the strap 36 back over itself after feeding an end thereof through the buckle frame 39, and then wrapping the strap one or more times around the wrist until a first part of the hook 38*a* and loop 38*b* closure system 38 securably engages with a second complementary part of the hook 38*a* and loop 38*b* closure system 38 in removable relation. With the gymnastics grip 20 so removably secured to the wrist and fingers of the gymnast, the substantially cylindrical dowel member 24 is positioned in substantially transverse relation to the gymnast's fingers and to the longitudinal axis "A".

In performing a gymnastics routine on the uneven bars or the rings, the gymnast naturally aligns the dowel axis "B" of the gymnastics grip 20 in substantially parallel relation either with a longitudinal axis of one of the uneven bars, or with a plane passing through three cross-sectional centers of a single one of the rings, as appropriate, thereby encouraging use of proper technique and grip on the apparatus, with the concomitant advantage of reducing muscle fatigue in the forearms, wrists, hands and fingers of the gymnast. Also, with the dowel axis "B" being aligned as aforesaid relative to the apparatus, the positioning of the dowel member 24 allows the gymnast to exert an increased pressure on the apparatus when desired, thereby helping the gymnast to maintain his or her hold thereon.

As is evident from the preceding description, and unlike the prior art, the preferred embodiment of the present gymnastics grip 20 does not have any stitching exposed wristward of the dowel member 24; the two first rows of stitching 50, 50 are instead protected within the flap member 42 thereby decreasing the forces directly at work upon same. Accordingly, the flap member 42 of the gymnastics grip 20 is less prone to unravelling and detachment, with the dowel member 24 being likewise protected, thus providing the gymnastics grip 20 of the present invention with an increased durability, strength and useful lifetime. As such, the gymnastics grip 20 of the present invention is less likely to fail mid-routine. This fact, combined with the grip's function in helping the gymnast to maintain his or her hold on the apparatus, greatly reduces the risk of serious injury to gymnasts using the gymnastics grip 20 of the present invention. Furthermore, because the two first rows of stitching 50, 50 are not in direct contact with the palm or fingers of the gymnast, a more comfortable grip upon the apparatus is provided that reduces the predisposition for callous formation on the gymnast's fingers and hands.

Figure 2:
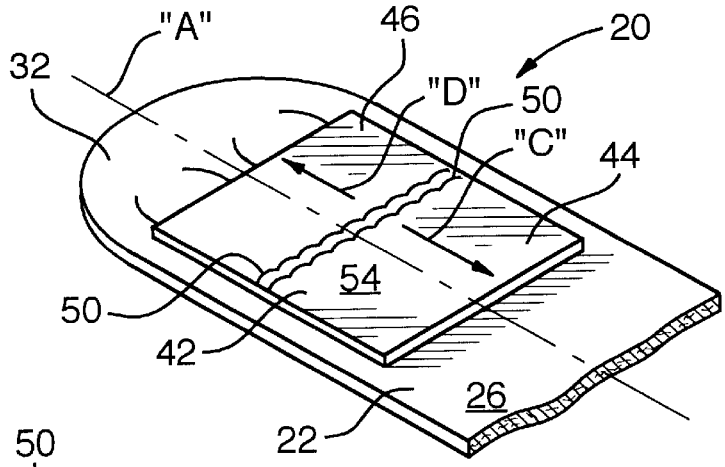
FIG. 2 is a perspective view of a finger end portion of the gymnastics grip of FIG. 1, shown in a first assembly configuration.
Figure 2A:
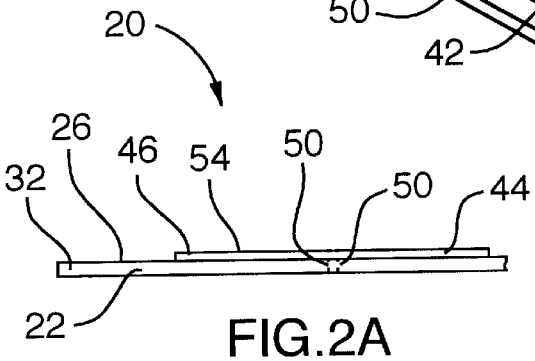
FIG. 2A is a left side elevational view of the gymnastics grip of FIG. 2.

According to the invention, there is also disclosed a process for making the gymnastics grip 20. FIGS. 2 through 5A depict a number of assembly configurations, each corresponding to the completion of an individual step to be performed successively in the process disclosed herein for making the gymnastics grip 20. In FIGS. 2 and 2A, the first assembly configuration is shown. This first assembly configuration is arrived at by securing the flap member 42 adjacent to the palm face 26 of the palm portion 22, and adjacent to the finger end portion 32, through the application of the two first rows of stitching 50, 50, each passing through the flap member 42 and the palm face 26 in substantially transverse relation to the longitudinal axis "A". According to the preferred process for making the gymnastics grip 20, the flap member 42 is oriented relative to the palm portion 22, such that the first flap portion 44 extends from the two first rows of stitching 50, 50 in a substantially wristward direction, being substantially towards the wrist end portion 28 of the palm portion 22, with the first direction "C" accordingly being oriented in a likewise manner. Conversely, also in the preferred process, the second flap portion 46 extends in a substantially fingerward direction, being substantially towards the finger end portion 32 of the palm portion 22, with the second direction "D" being similarly oriented. After so attaching the flap member 42 to the palm face 26, an adhesive may optionally be applied to the inner face 54 of the flap member 42 to aid in securing the dowel member 24 to the palm portion 22.

Figure 3:
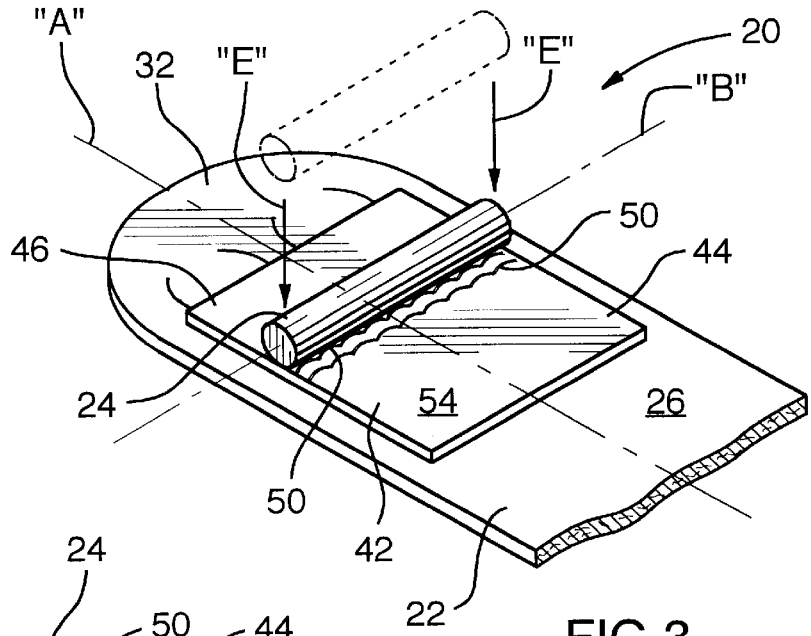
FIG. 3 is a perspective view of the finger end portion of the gymnastics grip of FIG. 1, shown in a second assembly configuration and showing a dowel member in phantom outline.
Figure 3A:
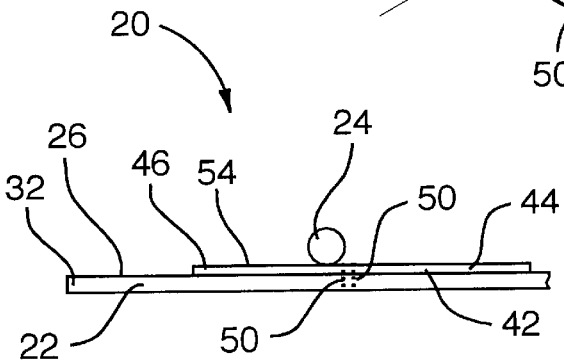
FIG. 3A is a left side elevational view of the gymnastics grip of FIG. 3.

The second assembly configuration, shown in FIGS. 3 and 3A, is then arrived at by moving the substantially cylindrical dowel member 24 from a detached position (shown in phantom outline in FIG. 3), in a third direction (indicated by arrow "E" in FIG. 3), to a position adjacent to the two first rows of stitching 50, 50 with the dowel axis "B" in substantially transverse relation to the longitudinal axis "A", and with the dowel axis "B" in substantially parallel relation to the first two rows of stitching 50, 50.

Figure 4:
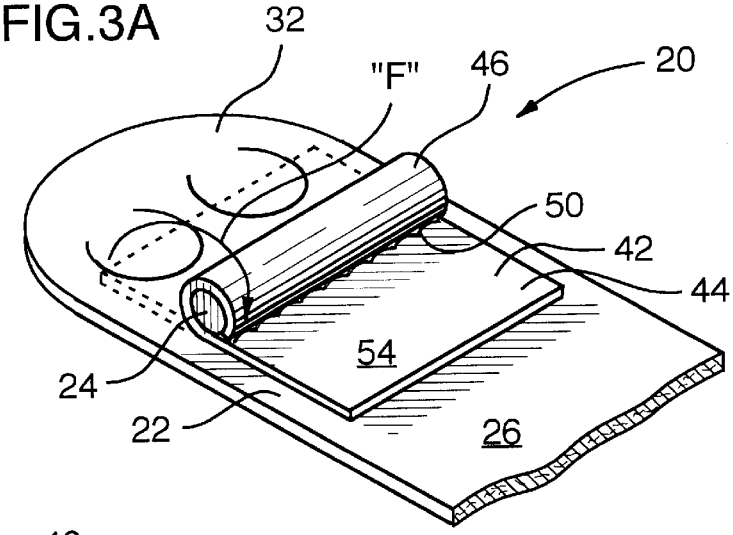
FIG. 4 is a perspective view of the finger end portion of the gymnastics grip of FIG. 1, shown in a third assembly configuration and showing a second flap portion in phantom outline.
Figure 4A:
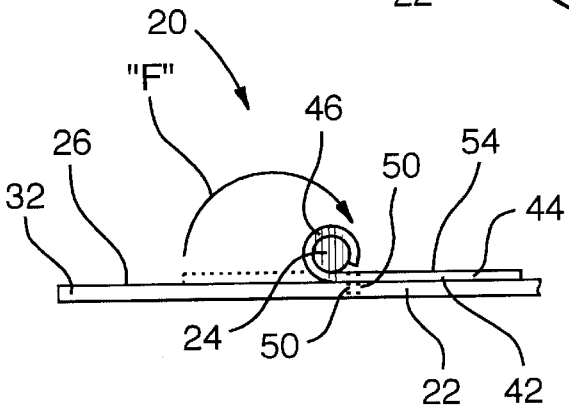
FIG. 4A is a left side elevational view of the gymnastics grip of FIG. 4.

With specific reference to FIGS. 4 and 4A, a third assembly configuration, shown therein, is next arrived at by moving the second flap portion 46 of the flap member 42 from an initial second flap position (shown in phantom outline), in a fourth direction (as indicated by arrow "F"), so as to substantially surround the dowel member 24. In the third assembly configuration, the second flap portion 46 extends from the first two rows of stitching 50, 50 in second encircling relation about the dowel member 24.

Figure 5:
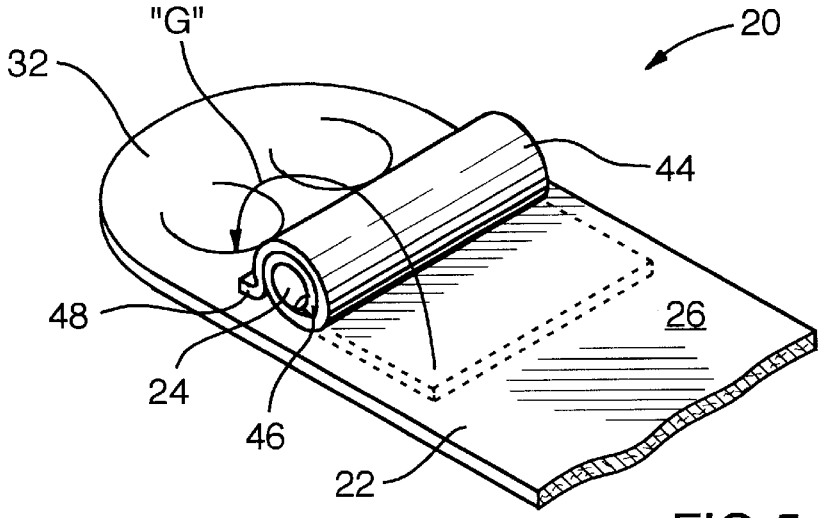
FIG. 5 is a perspective view of the finger end portion of the gymnastics grip of FIG. 1, shown in a fourth assembly configuration and showing a first flap portion in phantom outline.
Figure 5A:
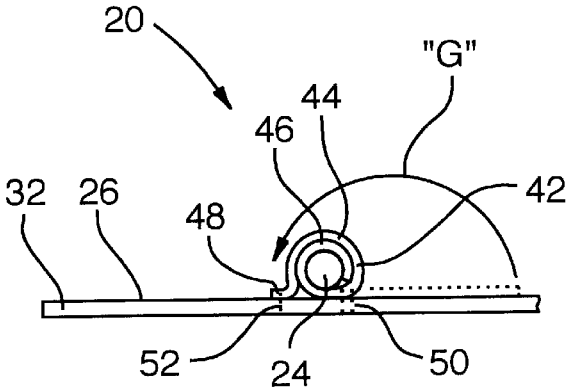
FIG. 5A is a left side elevational view of the gymnastics grip of FIG. 5.

In order to arrive at a fourth assembly configuration, shown in FIGS. 5 and 5A, the first flap portion 44 is moved from an initial first flap position (shown in phantom outline in FIGS. 5 and 5A), in a fifth direction (as indicated by arrow "G"), so as to substantially surround both the dowel member 24 and the second flap portion 46. In the fourth assembly configuration, the first flap portion 44 extends from the first two rows of stitching 50, 50 in first encircling relation about both the dowel member 24 and the second flap portion 46, without intervening between the first two rows of stitching 50, 50 and the dowel member 24 (as is most clearly illustrated in FIG. 5A). The first flap portion 44 is then secured adjacent the free end 48 thereof to the palm face 26 by applying a second row of stitching 52 passing through the free end 48 and the palm face 26 in substantially parallel relation to the two first rows of stitching 50, 50. According to the preferred process for making the gymnastics grip 20, the second row of stitching 52 passes through the palm face 26 at a position located between the finger end portion 32 and the two first rows of stitching 50, 50.

According to the preferred process disclosed herein, a first additional step, comprising the shaping of the finger end portion 32 so as to define the two finger holes 35, may be performed prior to, concurrent with, or following the performance of any one of the individual steps corresponding with the various assembly configurations discussed above.

Further, a second additional step may be performed prior to, concurrent with, or following the performance of the first additional step or any one of the individual steps corresponding with the various assembly configurations discussed above. In the second additional step, the strap 36 is attached to the wrist end portion 28. The strap 36 is provided with means for self closure comprising, in the preferred embodiment, a buckle frame 39 and a Velcro™ hook 38*a* and loop 38*b* closure system 38.

The process described in the preceding paragraphs is relatively easy to perform, requiring only such stitching skills as are already common in the industry, such that the gymnastics grip 20 to be made thereby is relatively inexpensive to manufacture.

Other modifications and alterations may be used in the design and manufacture of the gymnastics grip 20, and the process for making same, according to the present invention without departing from the spirit and scope of the invention, which is limited only by the accompanying claims. For example, the gymnastics grip 20 may be provided with three finger holes, rather than two, so as to allow its use on the high bar. In another example, the second row of stitching 52 might pass through the palm face 26 at a position located between the two first rows of stitching 50, 50 and the wrist end portion 28, rather than between the two first rows of stitching 50, 50 and the finger end portion 32. Likewise, the flap member 42 might be provided without a second flap portion 46 altogether, such that the first flap portion 44 would surround only the dowel member 24 in first encircling relation. Further, the wrist end securing means 30 might instead comprise two or more straps. As a still further example of a modification or alteration which may be used in the design and manufacture of the gymnastics grip 20, and the process for making same, according to the present invention, the means for self closure of the strap 36 might comprise the shaping of the strap 36 so as to define a number of strap holes therethrough, together with the provision of a buckle tongue, attached to the buckle frame 39, for secure and removable engagement with the strap holes.

I claim:

1. A gymnastics grip comprising in combination:

a palm portion defining a longitudinal axis and comprising a palm face, a wrist end portion, means for securing the wrist end portion to a wrist of a gymnast, a finger end portion, and means for securing the finger end portion to at least one finger of the gymnast;

a substantially cylindrical dowel member defining a dowel axis;

means for attaching said dowel member to said palm face adjacent said finger end portion with said dowel axis in substantially transverse relation to said longitudinal axis, said dowel attaching means comprising a flap member secured adjacent to said palm face by one or more first rows of stitching passing through said flap member and said palm face in substantially parallel relation to said dowel axis, wherein a first flap portion of said flap member extends in a first direction from said one or more first rows of stitching to substantially surround said dowel member in first encircling relation, said first flap portion being secured adjacent a free end thereof to said palm face by one or more second rows of stitching passing through said free end and said palm face in substantially parallel relation to said one or more first rows of stitching, wherein said one or more first rows of stitching are adjacent to said dowel member without said first flap portion intervening therebetween; and a second flap portion of said flap member extends in a second direction, opposed to said first direction, from said one or more first rows of stitching to substantially surround said dowel member in second encircling relation, such that said first flap portion substantially surrounds both said dowel member and said second flap portion in said first encircling relation.

2. A gymnastics grip according to claim 1, wherein said dowel attaching means is oriented such that said one or more second rows of stitching are positioned between said finger end portion and said one or more first rows of stitching.

3. A gymnastics grip according to claim 2, wherein said one or more first rows of stitching comprise two or more first rows of stitching.

4. A gymnastics grip according to claim 3, wherein said finger end securing means comprises the shaping of the finger end portion so as to define at least two finger holes.

5. A gymnastics grip according to claim 4, wherein said flap member further comprises an inner face with an adhesive applied thereto.

6. A gymnastics grip according to claim 5, wherein said palm portion and said flap member are constructed from leather.

7. A gymnastics grip according to claim 6, wherein said dowel member is constructed from a semi-rigid plastics material selected from the group consisting of ethylene vinyl acetate, nylon, polyester, polyethylene, polypropylene, polyurethane, polyvinyl chloride, silicone, natural rubber, and synthetic rubber, such as, for example, neoprene.

8. A gymnastics grip according to claim 7, wherein said wrist end securing means comprises at least one strap attached to said wrist end portion, with said at least one strap comprising means for self-closure.

9. A gymnastics grip according to claim 8, wherein said self-closure means comprises a hook and loop closure system.

10. A process for making a gymnastics grip comprising the steps of:

(a) providing a flap member having a first flap portion and a second flap portion and securing said flap member adjacent to a palm face of a palm portion and adjacent to a finger end portion of said palm portion, said palm portion defining a longitudinal axis, by applying one or more first rows of stitching passing through said flap member and said palm face in substantially transverse relation to said longitudinal axis;

(b) positioning a substantially cylindrical dowel member, defining a dowel axis, adjacent to said one or more first rows of stitching with said dowel axis in substantially transverse relation to said longitudinal axis;

(b.1) substantially surrounding said dowel member with the second flap portion of said flap member extending in second encircling relation about said dowel member from said one or more first rows of stitching;

(c) substantially surrounding said dowel member with a first flap portion of said flap member extending in first encircling relation about said dowel member from said first row of stitching, without said first flap portion intervening between said first row of stitching and said dowel member; and such that said first flap portion substantially surrounds both said dowel member and said second flap portion in said first encircling relation; and (d) securing said first flap portion adjacent a free end thereof to said palm face by applying one or more second rows of stitching passing through said free end and said palm face in substantially parallel relation to said first row of stitching.

11. A process for making a gymnastics grip according to claim 10, wherein, in step (d), said one or more second rows of stitching are made to pass through said palm face at a position located between said finger end portion and said one or more first rows of stitching.

12. A process for making a gymnastics grip according to claim 11, wherein, in step (a), two or more first rows of stitching are applied.

13. A process for making a gymnastics grip according to claim 12, further comprising, prior to, concurrent with, or following any one of steps (a) through (d), the first additional step of shaping said finger end portion so as to define at least two finger holes.

14. A process for making a gymnastics grip according to claim 13, further comprising, between steps (a) and (b), the step (a.1) of applying an adhesive to an inner face of said flap member.

15. A process for making a gymnastics grip according to claim 14, further comprising, prior to, concurrent with, or following any one of steps (a) through (d) or said first additional step, the second additional step of attaching at least one strap to a wrist end portion of said palm portion, with said at least one strap comprising means for self-closure.

16. A process for making a gymnastics grip according to claim 15, wherein, in said second additional step, said self-closure means is formed by applying a hook and loop closure system to the strap.

* * * * *